US006009387A

United States Patent [19]

Ramaswamy et al.

[11] Patent Number: 6,009,387

[45] Date of Patent: Dec. 28, 1999

[54] SYSTEM AND METHOD OF COMPRESSION/DECOMPRESSING A SPEECH SIGNAL BY USING SPLIT VECTOR QUANTIZATION AND SCALAR QUANTIZATION

[75] Inventors: Ganesh Nachiappa Ramaswamy, Ossining; Ponani Gopalakrishnan, Yorktown Heights; Joseph Morris, Flushing, all of N.Y.

[73] Assignee: International Business Machines Corporation, Armonk, N.Y.

[21] Appl. No.: 08/821,747

[22] Filed: Mar. 20, 1997

[51] Int. Cl.[6] ..... G10L 3/02

[52] U.S. Cl. ..... 704/222; 704/270

[58] Field of Search ..... 704/221, 222, 704/500; 348/418; 318/422

[56] References Cited

U.S. PATENT DOCUMENTS

| | | | |
|---|---|---|---|
| 5,271,089 | 12/1993 | Ozawa | 704/222 |
| 5,487,128 | 1/1996 | Ozawa | 704/222 |
| 5,649,051 | 7/1997 | Rothweiler et al. | 704/222 |
| 5,668,925 | 9/1997 | Rothweiler et al. | 704/222 |
| 5,673,364 | 9/1997 | Bialik | 704/500 |
| 5,729,655 | 3/1998 | Kolesnik et al. | 704/262 |

OTHER PUBLICATIONS

Law et al. Split–Dimension Vector Quantization of Parcor Coefficients for Low Bit Rate Speech Coding. IEEE Transactions on Speech and Audio Processing. vol. 2, No. 3, Jul. 1994.

Law et al. A Novel Split Resideual Vector Quantization Scheme for Low Bit Rate Speech Coding. Acoustics, Speech and Signal Processing. vol. 1, 1994.

Zeger et al. A Parallel Processing Algorithm for Vector Quantizer Design Based on Subpartitioning. Acoustics, Speech and Signal Processing. vol. 2, Jul. 1991.

Furui et al. Advances in Speech Signal Processing. 1992. pp. 49–51, 58–77.

*Primary Examiner*—David R. Hudspeth
*Assistant Examiner*—M. David Sofocleous
*Attorney, Agent, or Firm*—F. Chau & Associates, LLP

[57] ABSTRACT

Apparatus for processing acoustic features extracted from a sample of speech data forming a feature vector signal every frame period includes a first linear prediction analyzer, a vector quantizer, at least one partitioned vector quantizer and a scalar quantizer. The first linear prediction analyzer performs a linear prediction analysis on the feature vector signal to generate a first error vector signal. Next, the vector quantizer performs a vector quantization on the first error signal thereby generating a first index corresponding to a first prestored vector signal which is an approximation of the first error vector signal. The vector quantizer also generates a residual vector signal which is the difference between the first error vector signal and the first prestored approximation vector signal. Next, the at least one partitioned vector quantizer performs a partitioned vector quantization on a first portion of the residual vector signal thereby generating at least one second index corresponding to a second prestored vector signal which is an approximation of the first portion of the residual vector signal. Next, the scalar quantizer performs a scalar quantization on a second portion of the residual vector signal thereby generating a third index corresponding to a prestored scalar signal which is an approximation of the second portion of the residual vector signal. The first, second and third indices are combined to form an encoded vector signal which is a compressed representation of the feature vector signal. The encoded vector signal may be transmitted and/or stored as desired. The feature vector signal may be reconstructed from the encoded vector signal by adding the corresponding prestored signals to the encoded vector signal to form a decompressed representation of the feature vector signal.

8 Claims, 6 Drawing Sheets

SYSTEM AND METHOD OF COMPRESSION/DECOMPRESSING A SPEECH SIGNAL BY USING SPLIT VECTOR QUANTIZATION AND SCALAR QUANTIZATION

BACKGROUND OF THE INVENTION

This invention relates to data compression and data decompression of acoustic features associated with sampled speech data in a speech recognition system.

Typically, an initial step in a computerized speech recognition system involves the computation of a set of acoustic features from sampled speech. The sampled speech may be provided by a user of the system via an audio-to-electrical transducer, such as a microphone, and converted from analog representation to a digital representation before sampling. An example of how these acoustic features may be computed is described in the article entitled "Speech Recognition with Continuous Parameter Hidden Markov Models," by Bahl et al., Proceedings of the IEEE ICASSP, pp. 40–43 (May 1988). These acoustic features are then submitted to a speech recognition engine where the utterances are recognized. In a speech recognition system employing a client-server model, the acoustic features are computed on the client system and then have to be transmitted to the server system for recognition. It is necessary to compress the acoustic features to minimize the bandwidth requirements for the transmission. Compression is also necessary in more general speech recognition systems where storage of the acoustic features is desired.

The topic of speech compression has been well researched over the years (e.g., "Speech Coding and Synthesis," by Klein et al., Elsevier (1995)), but all of the proposed solutions only address the problem of compressing and reproducing speech that sounds acceptable to a human ear. The problem addressed by the present invention, on the other hand, is to compress (and decompress) the acoustic features computed (i.e., extracted) from spoken utterances for the purpose of subsequent machine recognition of speech.

SUMMARY OF THE INVENTION

It is an object of the present invention to provide apparatus and methods for compressing and decompressing the acoustic features associated with sampled speech data in a speech recognition system.

It is another object of the present invention to provide apparatus and methods for compressing and decompressing the acoustic features associated with sampled speech data in a speech recognition system such that the speech recognition system operating on data subjected to compression and decompression does not experience substantial degradation in overall performance.

It is yet another object of the present invention to provide apparatus and methods for compressing and decompressing the acoustic features associated with sampled speech data in a speech recognition system which are not substantially complex such that the computational resources needed for the compression and decompression process are not substantially large.

The present invention accomplishes these and other objects by providing a unique data compressor (and concomitant compression process) to encode the acoustic features. The compression process results in a reduction of bandwidth by at least a factor of ten, and requires only limited computational resources, while preserving the overall performance level of the subsequent speech recognition process. The compression process starts with a linear prediction stage. The error in the prediction is first subjected to a tree-structured vector quantization, and the residual is subjected to partitioned tree-structured vector quantization and scalar quantization process. The indices corresponding to the quantization codebook entries are assembled in a compact fashion and transmitted or stored. During the decompression process, the indices are extracted from the compact representation and the acoustic features are reconstructed by referencing the codebooks.

These and other objects, features and advantages of the present invention will become apparent from the following detailed description of illustrative embodiments thereof, which is to be read in connection with the accompanying drawings.

DETAILED DESCRIPTION OF PREFERRED EMBODIMENTS

Figure 1:
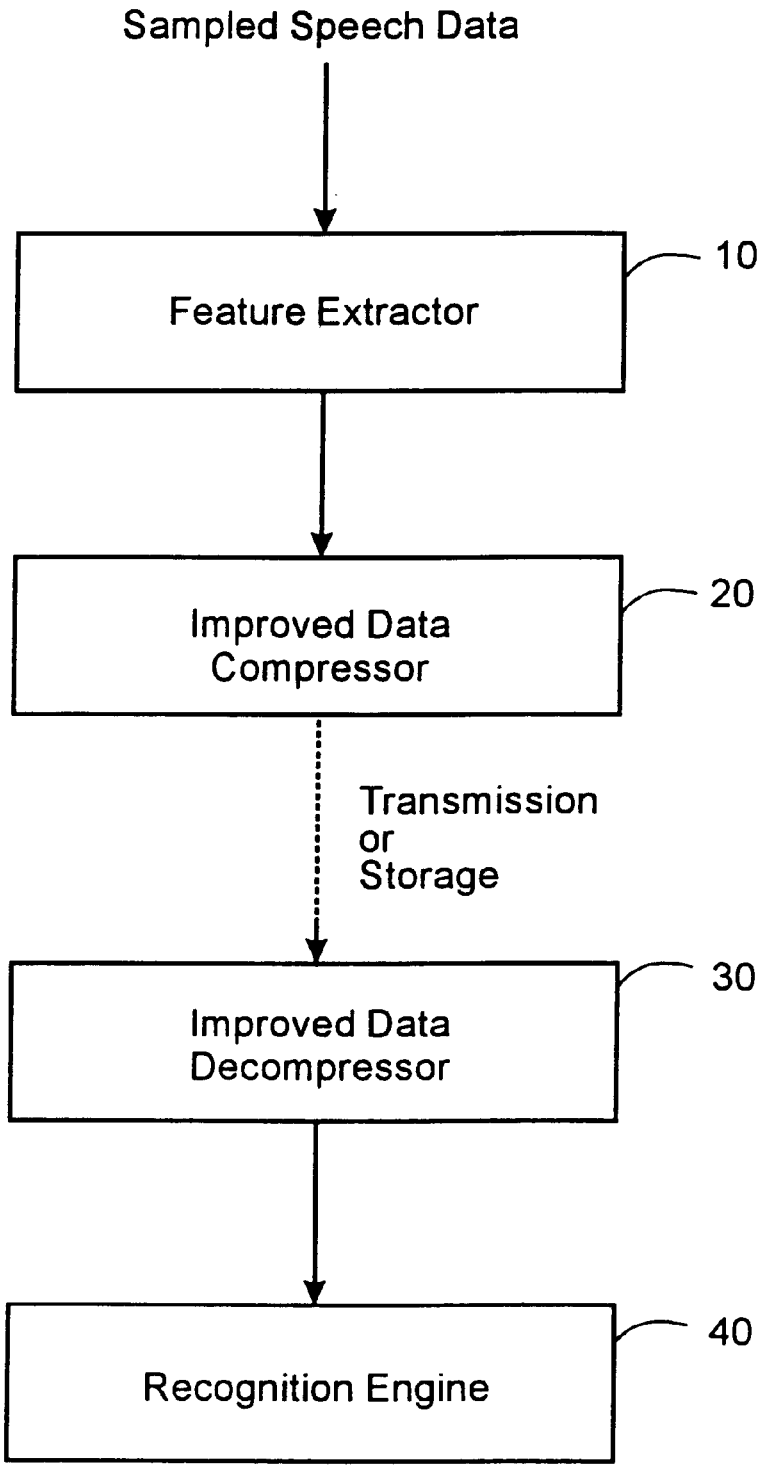
FIG. 1 is a simplified block diagram illustrating a speech recognition system including a data compressor and a data decompressor in accordance with the invention.

FIG. 1 is a simplified block diagram of a preferred apparatus for performing speech recognition which generally includes a feature extractor 10, a data compressor 20, a data decompressor 30 and a recognition engine 40. The block diagram illustrates the preferred placement of the data compressor 20 and decompressor 30, formed in accordance with the present invention, within the overall speech recognition system. Specifically, a digital signal representative of speech data (e.g., signal typically input by a user through a microphone and then converted from an analog representation to a digital representation) is provided to feature extractor 10. The feature extractor 10 extracts (i.e., calculates) the acoustic features from the sampled speech data signal. It is to be appreciated that several suitable methods for extracting acoustic features from sampled speech data are known to one ordinarily skilled in the art. For instance, a suitable procedure for extracting such features is disclosed in the Bahl et al. reference mentioned above, the disclosure of which is incorporated herein by reference. In a preferred form of the feature extractor 10, a vector signal containing thirteen (13) acoustic features (referred to hereinafter as a feature vector signal) is generated by the feature extractor 10 for each successive frame period. A frame period is defined as a fixed interval corresponding to a duration of time associated with the sampled speech data. A preferred frame period, used in accordance with the present invention, may be ten milliseconds (10 msec). It is to be appreciated that such acoustic features may, for example, be defined as mel cepstral coefficients (or some variation thereof), the generation of which is known in the art. Nonetheless, the acoustic features generally correspond to numeric measurements which approximate the envelope of the spectrum associated with a particular frame period of the input speech data.

The feature vector signal is then provided to a data compressor 20. The data compressor 20 compresses the acoustic features of the feature vector signal to form a compressed vector signal (referred to hereinafter as an encoded vector signal) in a manner which will be described in detail below. Once compressed, the acoustic features (i.e., the encoded vector signal) may be transmitted in any known manner, e.g., wireless transmission, and/or stored in a data storage unit for future use and/or transmission.

After transmission and/or storage, the encoded vector signal representing the compressed acoustic features is provided to a data decompressor 30 where the features are decompressed to form a decompressed vector signal (referred to hereinafter as a reconstructed vector signal) in a manner which will be described in detail below. The reconstructed vector signal is then provided to a recognition engine 40 where the speech data contained in the signal is recognized in any suitable manner for recognizing spoken utterances known in the art.

It is to be appreciated that the components of the speech recognition system described herein and, in particular, the data compressor and data decompressor, may be implemented in either hardware or software, or a combination thereof. For this reason, the components of the present invention are generally described herein in terms of the function that each component performs within the system of the invention.

Figure 2:
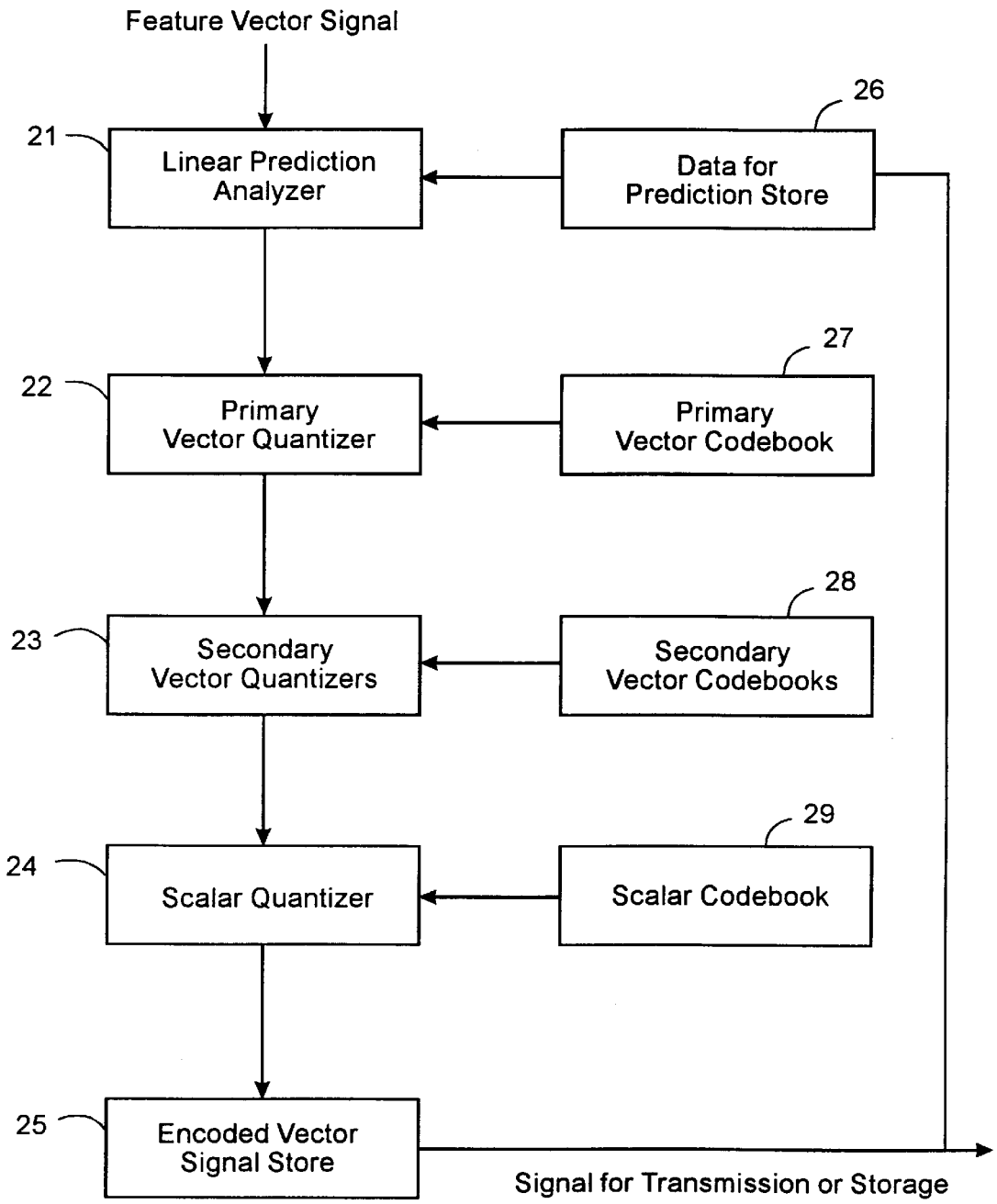
FIG. 2 is a block diagram illustrating a data compressor in accordance with the invention.

Referring now to FIG. 2, a preferred data compressor 20 of the present invention is shown in greater detail. Particularly, for each frame period, the computed feature vector signal containing the acoustic features extracted by the feature extractor 10 is provided to a linear prediction analyzer 21. In a preferred embodiment of the invention, the linear prediction analyzer 21 performs a one-step calculation whereby the feature vector signal in a current frame period is compared to either the encoded vector signal from the previous frame period or a precomputed mean vector signal in order to generate an error vector signal. As will be explained, the encoded vector signal is the resulting signal generated by the data compressor 20.

Figure 3:
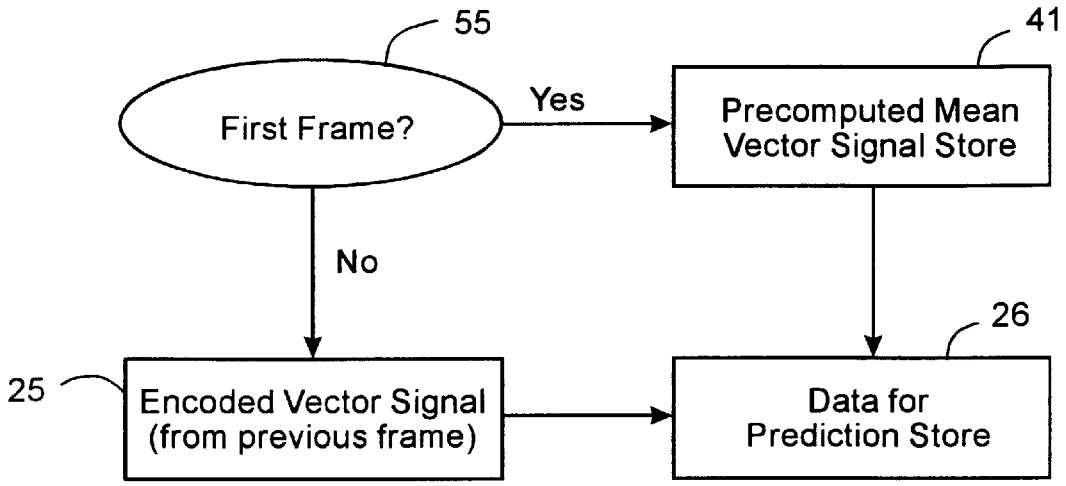
FIG. 3 is a flow chart/block diagram illustrating a computational process for determining the data for prediction for the compression process of the invention.

More specifically, as shown in the flow chart/block diagram of FIG. 3, the linear prediction analyzer 21 further includes a data for prediction store 26 operatively coupled to an encoded vector signal store 25 and a precomputed mean vector signal store 41. First, the linear prediction analyzer 21 determines whether the current frame period is the first frame period to be processed (decisional block 55) during this particular session of data compression. When the current frame period is not the first frame period, the prediction data stored in the data for prediction store 26 is provided from the encoded vector signal store 25. It is to be appreciated that the data from the encoded vector signal store 25 corresponds to the encoded vector signal generated by the data compressor 20 in the previous frame period. However, if the current frame period is the first frame period to be processed during this particular session of data compression, the data for prediction stored in prediction store 26 is data associated with a precomputed mean vector signal which is stored in precomputed mean vector signal store 41. The procedure for generating the precomputed mean vector signal will be described later in the context of FIG. 6. In either case, the data for prediction (i.e., the encoded vector signal or the precomputed mean vector signal) and the current feature vector signal are compared by the linear prediction analyzer 21 and an error vector signal representing the difference between the current feature vector signal and the data for prediction is generated in response to this comparison.

Next, the error vector signal generated by the linear prediction analyzer 21 is provided to a primary vector quantizer 22. Specifically, the primary vector quantizer 22 compares the error vector signal, using a specified distance measure (e.g., the Euclidean distance), to indexed values (i.e., entries) contained in a primary vector codebook 27 operatively coupled to the primary vector quantizer 22. The indexed values respectively correspond to prestored approximation vector signals which may preferably be generated in the manner described in the context of FIG. 6. Each indexed value has a unique index associated therewith. The error vector signal is assigned to the indexed value whose prestored approximation vector signal most closely approximates the error vector signal (i.e., closest entry from the primary vector codebook 27). In a preferred embodiment of the invention, the primary vector codebook 27 contains 4,096 indexed values, whereby each indexed value represents a different multi-dimensional prestored approximation vector signal. As previously explained, the feature vector signal and, thus, the error vector signal contain thirteen acoustic features and therefore is considered a thirteen-dimensional vector signal. Accordingly, the prestored approximation vector signals are preferably thirteen-dimensional vector signals.

In order to speed-up the search through the 4,096 entries, a tree-structured arrangement is imposed on the codebook 27, whereby the 4,096 indexed values are grouped into 64 groups with each group having 64 indexed values contained therein. Next, a group mean vector signal is determined for each of the 64 groups by averaging the vector signals contained in the group and each of these 64 mean vector signals is assembled (i.e., stored) into another intermediate codebook also operatively coupled to the primary vector quantizer 22. First, the error vector signal from the linear prediction analyzer 21 is preferably compared using the Euclidean distance to the 64 entries (i.e., group mean vector signals) in the intermediate codebook and the closest match found. Once the closest group is determined, the error vector signal is then compared to the 64 indexed values within that particular group in the primary vector codebook 27 to determine the indexed value within the primary vector codebook 27 whose associated prestored approximation vector signal is closest to the error vector signal. Accordingly, there are preferably 128 comparisons made during the vector quantization process performed by the primary vector quantizer 22 in order to determine the index which represents the indexed value of the prestored vector signal most closely approximating the error vector signal.

Once the closest indexed value is determined from the primary vector codebook 27, a residual vector signal is generated which is representative of the difference between the prestored approximation vector signal associated with the chosen indexed value from the primary vector codebook 27 and the error vector signal from the linear prediction analyzer 21.

The residual vector signal from the primary vector quantizer 22 is then provided to secondary vector quantizers 23 where the residual vector signal is partitioned into sub-vector signals and each sub-vector signal is compared using a distance measure, such as the Euclidean distance, to indexed values in corresponding secondary vector codebooks 28 which are operatively coupled to the secondary vector quantizers 23. It is to be appreciated that each of the secondary vector codebooks 28 may preferably have a similar tree-structured arrangement as the primary vector codebook 27.

In a preferred embodiment, the residual vector signal from the primary vector quantizer 22, which is comprised of thirteen acoustic features (i.e., a thirteen-dimensional vector), is partitioned into three sub-vector signals of respective elemental dimensions of six, six and one with the first sub-vector signal containing the first six elements of the residual vector signal, the second sub-vector signal containing the second six elements of the residual vector signal and the final sub-vector signal containing the last element (also known as the energy element) of the residual vector signal. The first two six-dimensional sub-vector signals are respectively provided to secondary vector quantizers 23 (preferably two), and the last sub-vector signal, containing the energy element, is sent directly to a scalar quantizer 24 thereby bypassing the secondary vector quantization process.

In a preferred embodiment of the present invention, there are two secondary vector codebooks 28, one for the first six-dimensional sub-vector signal and one for the second six-dimensional sub-vector signal, and both of the secondary vector codebooks 28 preferably contain 4,096 indexed values whereby each indexed value represents a six-dimensional prestored approximation vector signal. In a manner similar to that explained above with respect to the primary vector quantization process, the 4,096 indexed values of each of the secondary vector codebooks 28 are separated into 64 groups of 64 indexed values each. Group mean vector signals for each of the 64 groups in each of the secondary vector codebooks are generated by averaging the vector signals within each group and the group mean vector signals are assembled into intermediate codebooks also operatively coupled to the secondary vector quantizers 23. Each of the six-dimensional sub-vector signals are compared to their corresponding intermediate codebooks to respectively determine the groups of 64 indexed values in the secondary vector codebooks 28 having group means vector signals which most closely approximate the particular sub-vector signals. Once the groups are determined, they are searched and the indexed values closest to each of the six-dimensional sub-vector signals are selected therefrom. Each selected indexed value which represents a prestored approximation vector signal has a unique index associated therewith.

In a preferred embodiment of the present invention, the scalar quantizer 24, operatively coupled to the secondary vector quantizers 23 and the scalar codebook 29, receives the thirteenth element of the residual vector signal from the primary vector quantizer (bypassing the secondary vector quantizers) and the scalar quantizer 24 assigns the element to the indexed value contained therein which corresponds to a prestored approximation scalar signal which most closely approximates the scalar element of the residual vector signal. Preferably, there are 16 indexed values in the scalar codebook 29. Each indexed value has a unique index associated therewith.

Next, the indices of the chosen indexed values in the primary vector codebook 27, the secondary vector codebooks 28 and the scalar codebook 29 are combined to form an encoded vector signal. The encoded vector signal may be stored in encoded vector signal store 25, as shown in FIG. 2. In a preferred embodiment of the invention, 40 data bits are used to form the encoded vector signal 25, with the first 12 data bits allocated for the index into the primary vector codebook 27, the second 12 bits allocated for the index into the first secondary vector codebook 28, the third 12 bits allocated for the index into the second secondary vector codebook 28 and the last 4 bits allocated for the index into the scalar codebook 29.

It is to be appreciated that, with a preferred frame period duration of 10 msec, 100 encoded vector signals may be computed per second, for a data rate of 4.0 kilobits/second. It is to be understood that without the data compression process performed by the data compressor 20 of the present invention, where thirteen-dimensional feature vector signals (in floating point representation) must be represented every 10 msec, the required data rate is approximately 41.6 kilobits/second. Therefore, the present invention advantageously provides for a reduction of bandwidth by a factor of more than 10 (41.6/4=10.4) by forming an encoded vector signal in the manner described herein. Such a significant reduction in bandwidth correspondingly provides a significant reduction in transmission channel bandwidth and/or storage capacity when such data is being transmitted and/or stored. Also, due to the relative simplicity of the compression process performed by the data compressor 20 of the present invention, the computational load imposed on a speech recognition system utilizing such a compression process is also significantly reduced.

Figure 4:
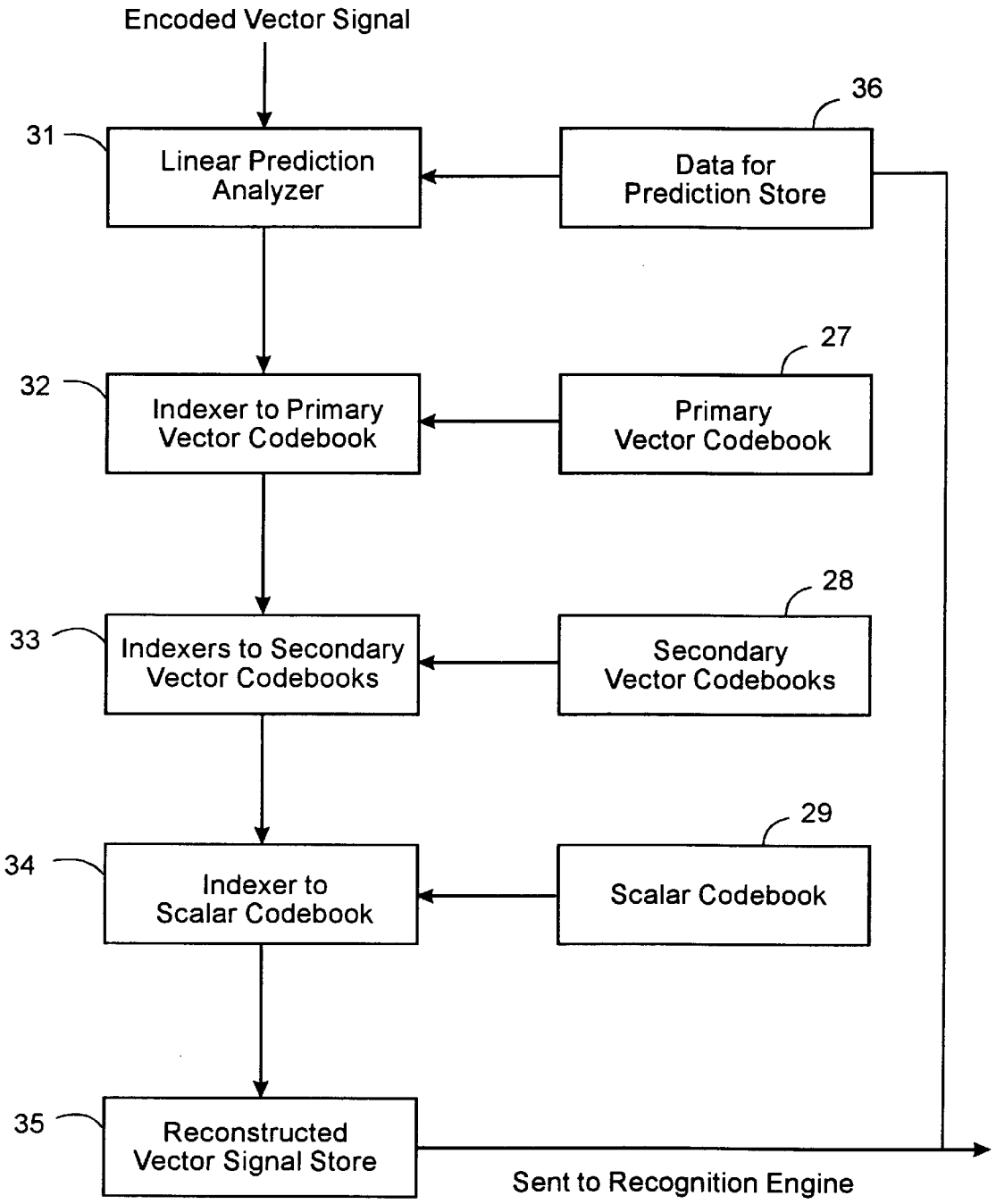
FIG. 4 is a block diagram illustrating a data decompressor in accordance with the invention.

Referring now to FIG. 4, a preferred data decompressor 30 of the present invention is shown in greater detail. Specifically, for every frame period, the encoded vector signal is provided to a linear prediction analyzer 31 (i.e., substantially similar to the linear prediction analyzer 21 of the data compressor 20). For every frame period, the linear prediction analyzer 31 performs a one-step linear prediction calculation whereby the encoded vector signal in the current frame period is compared to a reconstructed feature vector signal from the previous frame period or a precomputed mean vector signal in order to generate an error vector signal. As will be explained, the reconstructed feature vector signal is the resulting signal generated by the data decompressor 30 of the present invention.

Figure 5:
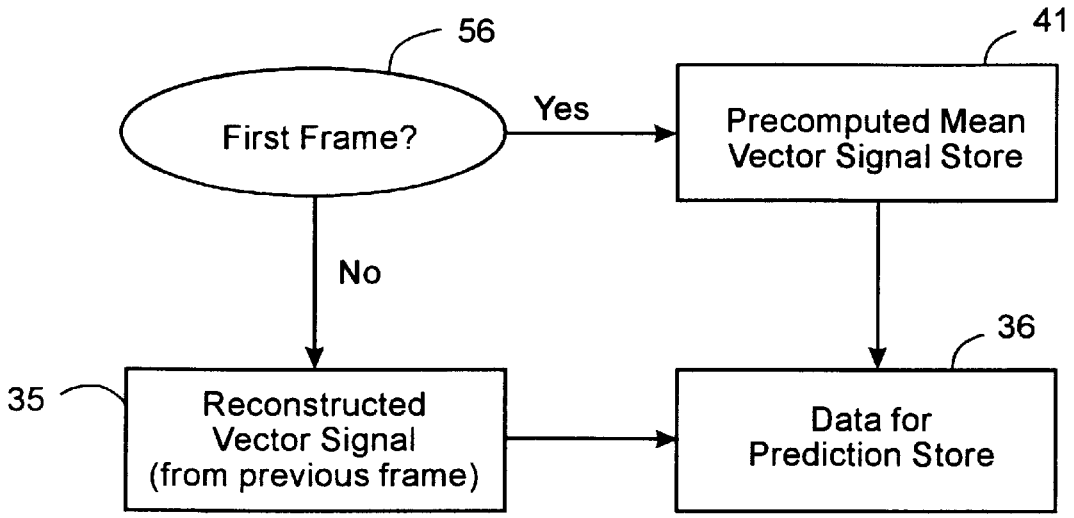
FIG. 5 is a flow chart/block diagram illustrating a computational process for determining the data for prediction for the decompression process of the invention.

More specifically, as illustrated in the flow chart/block diagram of FIG. 5, the linear prediction analyzer 31 further includes a data for prediction store 36 which is operatively coupled to a reconstructed vector signal store 35 and the precomputed mean vector signal store 41 (i.e., preferably the same precomputed mean vector store utilized in the linear prediction analyzer 21 of the data compressor 20). Accordingly, the linear prediction analyzer 31 determines whether the current frame period is the first frame period to be processed (decisional block 55) during this particular session of data decompression. When the current frame period is not the first frame period, the prediction data stored in the data for prediction store 36 is the data associated with the reconstructed feature vector signal stored in reconstructed vector signal store 35. However, if the current frame period is the first frame, then the data for prediction is provided by the precomputed mean vector signal store 41, in a similar manner as described for the compression process. In either case, the data for prediction (i.e., the data associated with the reconstructed vector signal from the previous frame period or the data associated with the precomputed mean vector signal) and the encoded feature vector signal are compared whereby an error vector signal is generated by the linear prediction analyzer 31 which represents the difference between the encoded vector signal and the data for prediction.

The error vector signal from the linear prediction analyzer 31 is then provided to an indexer to primary vector codebook 32 which is operatively coupled to the primary vector codebook 27. It is to be understood that the indexer 32 and codebook 27 preferably form a lookup table arrangement whereby each unique index may be used to locate the indexed value representing the prestored approximation signal which corresponds to the index. The indexer 32 extracts the index into the primary vector codebook 27 from the encoded vector signal, and the corresponding approximation signal representing the indexed value from the primary vector codebook 27 is added to the vector signal from the linear prediction analyzer 31. The resulting vector signal is provided to indexers to the secondary vector codebooks 33 (preferably two) which are respectively operatively coupled to the secondary vector codebooks 28. Indexers 33 and codebooks 28 also form respective lookup table arrangements. Again, the indices into the secondary vector codebooks 28 are respectively extracted by indexers 33 from the resulting vector signal, and the corresponding approximation signals representing the indexed values from the secondary vector codebooks 28 are respectively added to the resulting vector signal provided from the indexer 32. The resulting vector signal from indexers 33 is then provided to an indexer to scalar codebook 34, operatively coupled to the scalar codebook 29. The indexer 34 and the codebook 29 also form a lookup table arrangement. The index into the scalar codebook 29 is extracted by indexer 34 from the resulting vector signal provided from indexers 33 and the corresponding prestored approximation scalar signal represented by the indexed value from the scalar codebook 29 is added thereto.

Accordingly, the vector signal resulting from the respective addition by the three indexers of the three approximation signals relating to the indices is the reconstructed (i.e., decompressed) vector signal. The reconstructed vector signal may be stored in the reconstructed vector signal store 35 which is preferably operatively coupled to the recognition engine 40 (FIG. 1) and the remainder of the speech recognition process may be performed.

Figure 6:
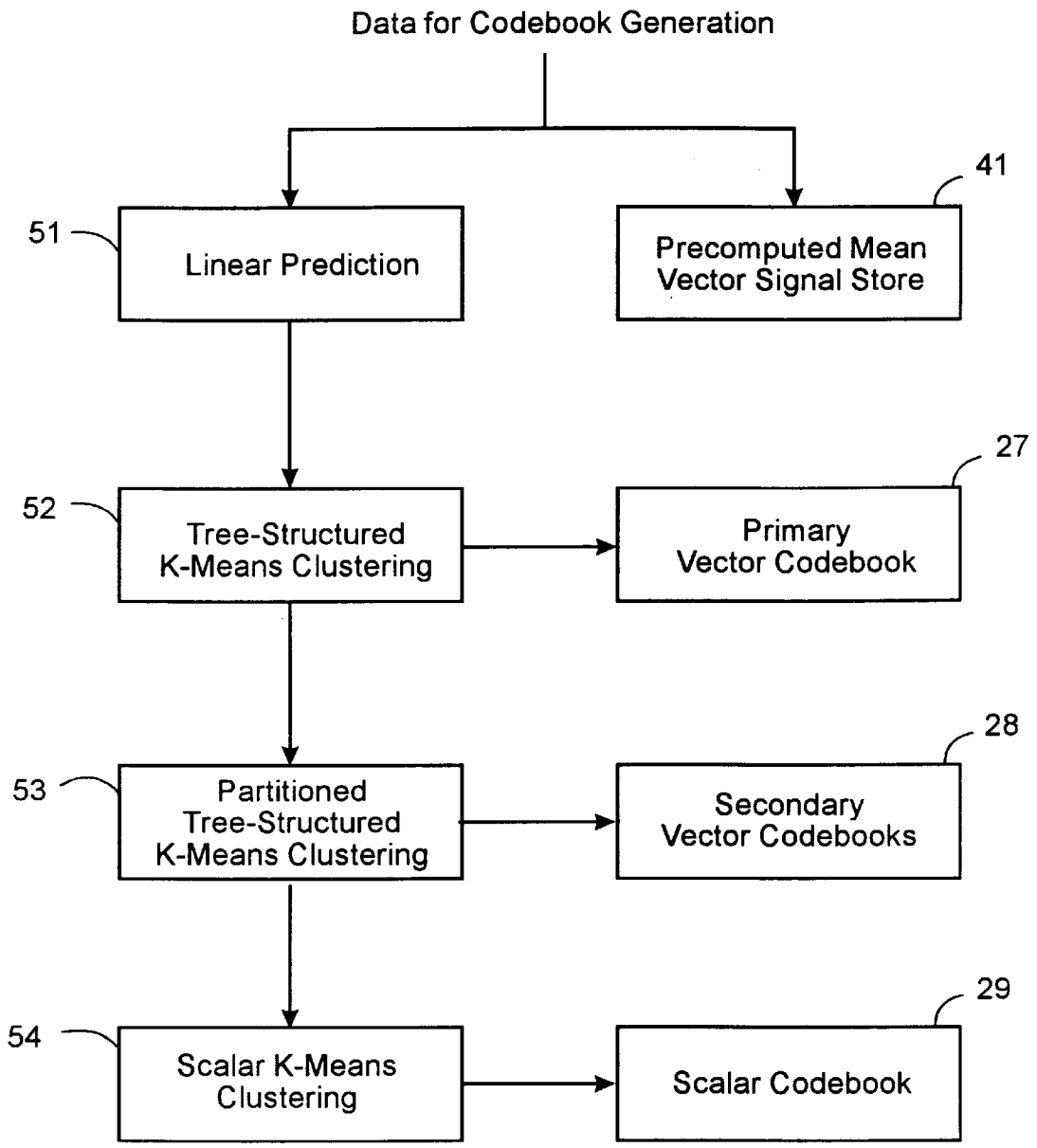
FIG. 6 is a block diagram illustrating a process for generating the codebooks for compression and decompression, and for generating a precomputed mean vector in accordance with the invention.

Referring now to FIG. 6, the preferred process for generating the individual indexed values of the primary vector codebook 27, the secondary vector codebooks 28, the scalar codebook 29 and the computed mean vector signal is shown. Particularly, the generation of the indexed values in the codebooks involves the use of a known clustering algorithm referred to as the K-means clustering algorithm, details of which are disclosed in the text entitled "Vector Quantization and Signal Compression," by Gersho et al. (Kluwer Academic Publishers) 1992, the disclosure of which is incorporated herein by reference. A substantial number of acoustic features are collected from empirical speech data to form the data for codebook generation. An average signal is computed from the empirical codebook generation data to form the precomputed mean vector signal which is stored in precomputed mean vector signal store 41 for use by the linear prediction analysis processes employed in data compression and decompression.

Further, in a preferred embodiment of the present invention, the codebook generation data is provided to yet another linear prediction analyzer 51 where the difference between adjacent vector signals is computed and then provided to a tree-structured K-means clustering unit 52 which generates the individual entries (i.e., indexed values) stored in the primary vector codebook 27 and the intermediate codebook associated with the primary vector codebook 27. The difference between the codebook generation data and the closest match in the primary vector codebook is computed for every vector signal associated with the data for codebook generation and is provided to both a partitioned tree-structured K-means clustering unit 53 and a scalar K-means clustering unit 54 to respectively generate the secondary vector codebooks 28 and the scalar codebook 29 in a similar manner. As mentioned before, in a preferred embodiment of the invention, there are two secondary vector codebooks 28 containing vector signals of six dimensions, corresponding to the first and second six elements of the feature vector signal, and the scalar codebook 29 contains scalar entries corresponding to the thirteenth element of the feature vector signal. The entries in the primary vector codebook preferably contain thirteen elements. The K-means clustering algorithm may be used to generate entries of substantially any specified size.

In order to reduce system memory requirements, in a preferred embodiment of the invention, the entries in the primary vector codebook 27, the secondary vector codebooks 28, the scalar codebook 29 and the precomputed mean vector signal contain only integer values. In such an embodiment, the feature vector signal may first be approximated to contain only integer values before being provided to the linear prediction analyzer 21.

Although illustrative embodiments of the present invention have been described herein with reference to the accompanying drawings, it is to be understood that the invention is not limited to those precise embodiments, and that various other changes and modifications may be affected therein by one skilled in the art without departing from the scope or spirit of the invention.

What is claimed is:

1. A stored program device readable by a computer, embodying a program for causing the computer to compress acoustic features extracted from a sample of speech data, forming a feature vector signal, the stored program device comprising:

a first linear prediction analyzer having codes causing said computer to perform a first linear prediction analysis on the feature vector signal and to generate a first error vector signal;

a vector quantizer having codes causing said computer to perform a vector quantization on the first error vector signal thereby generating a first index; a memory for storing a first prestored vector signal corresponding to said first index, said first prestored vector signal being an approximation of the first error vector signal, the vector quantizer for further generating a residual vector signal which is the difference between the first error vector signal and the first prestored approximation vector signal;

at least one partitioned vector quantizer having codes causing said computer to perform a partitioned vector quantization on a first portion of the residual vector signal thereby generating at least one second index which corresponds to a second prestored vector signal which is an approximation of the first portion of the residual vector signal;

a scalar quantizer having codes causing said computer to perform a scalar quantization on a second portion of the residual vector signal thereby generating a third index corresponding to a prestored scalar signal which is an approximation of the second portion of the residual vector signal;

a combiner module for causing said computer to combine the first, second and third indices to form an encoded vector signal which is a compressed representation of the feature vector signal;

means for causing said computer to store or transmit said compressed representation of the feature vector signal; and a primary vector codebook, responsive to the vector quantizer, containing indexed values representing prestored approximation vector signals wherein each indexed value and, thus, each prestored approximation vector signal corresponds to a particular index, wherein the indexed values in the primary vector codebook form a tree-structured arrangement wherein the indexed values are separated into groups with a group mean vector signal being generated and stored from the average of the prestored vector signals within the group such that the vector quantizer first performs an inter-group search to locate the group of indexed values corresponding to the prestored group mean vector signal which most closely approximates the first error vector signal and then performs an intra-group search to locate the indexed value corresponding to the particular prestored vector signal which most closely approximates the first error vector signal, such prestored vector signal serving as the first prestored approximation vector signal.

2. The processing apparatus as defined in claim 1, further comprising an intermediate codebook, responsive to the vector quantizer, wherein the group mean vector signals are contained therein such that the vector quantizer may perform the inter-group search.

3. A stored program device readable by a computer, embodying a program for causing the computer to compress acoustic features extracted from a sample of speech data, forming a feature vector signal, the stored program device comprising:

a first linear prediction analyzer having codes causing said computer to perform a first linear prediction analysis on the feature vector signal and to generate a first error vector signal;

a vector quantizer having codes causing said computer to perform a vector quantization on the first error vector signal thereby generating a first index; a memory for storing a first prestored vector signal corresponding to said first index, said first prestored vector signal being an approximation of the first error vector signal, the vector quantizer for further generating a residual vector signal which is the difference between the first error vector signal and the first prestored approximation vector signal;

at least one partitioned vector quantizer having codes causing said computer to perform a partitioned vector quantization on a first portion of the residual vector signal thereby generating at least one second index which corresponds to a second prestored vector signal which is an approximation of the first portion of the residual vector signal;

a scalar quantizer having codes causing said computer to perform a scalar quantization on a second portion of the residual vector signal thereby generating a third index corresponding to a prestored scalar signal which is an approximation of the second portion of the residual vector signal;

a combiner module for causing said computer to combine the first, second and third indices to form an encoded vector signal which is a compressed representation of the feature vector signal;

means for causing said computer to store or transmit said compressed representation of the feature vector signal; and at least one secondary vector codebook, responsive to the at least one partitioned vector quantizer, containing indexed values representing prestored approximation vector signals wherein each indexed value and, thus, each prestored approximation vector signal corresponds to a particular index, wherein the indexed values in the at least one secondary vector codebook form a tree-structured arrangement wherein the indexed values are separated into groups with a group means vector signal being generated and stored from the average of the prestored vector signals within the group such that the at least one partitioned vector quantizer first performs an inter-group search to locate the group of indexed values corresponding to the prestored group mean vector signal which most closely approximates the first portion of the residual vector signal and then performs an intra-group search to locate the indexed value corresponding to the particular prestored vector signal which most closely approximates the first portion of the residual vector signal, such prestored vector signal serving as the second prestored approximation vector signal.

4. The processing apparatus as defined in claim 3, further comprising a second partitioned vector quantizer, substantially similar to the at least one partitioned vector quantizer, and a second secondary vector codebook, responsive to the second partitioned vector quantizer which forms a tree-structured arrangement substantially similar to the at least one secondary vector codebook, and whereby the first portion of the residual vector signal is subdivided into a first sub-vector signal and a second sub-vector signal such that the prestored vector signal most closely approximating the first sub-vector signal is determined through the inter-group and intra-group searches of the at least one secondary vector codebook by the at least one partitioned vector quantizer and the prestored vector signal most closely approximating the second sub-vector signal is determined through an inter-group search and an intra-group search of the second secondary vector codebook by the second partitioned vector quantizer, such that a first sub-index and a second sub-index are respectively determined and combined to form the second index of the encoded vector signal.

5. The processing apparatus as defined in claim 4, further comprising at least one intermediate codebook, responsive to the at least one partitioned vector quantizer, wherein the group mean vector signals are contained therein such that the at least one partitioned vector quantizer may perform the inter-group search to locate the prestored group mean vector signal most closely approximating the first sub-vector signal.

6. The processing apparatus as defined in claim 5, further comprising a second intermediate codebook, responsive to the second partitioned vector quantizer, wherein the group mean vector signals are contained therein such that the second partitioned vector quantizer may perform the inter-group search to locate the prestored group mean vector signal most closely approximating the second sub-vector signal.

7. A stored program device accessible by a computer, having instructions executable by said computer to perform method steps for processing acoustic features extracted from a sample of speech data forming a feature vector signal, the method steps comprising:

a) performing a first linear prediction analysis on the feature vector signal to generate a first error vector signal in response thereto;

b) performing vector quantization on the first error vector signal thereby generating a first index which corresponds to a first prestored vector signal which is an approximation of the first error vector signal, the vector quantization sub-process also generating a residual vector signal which is the difference between the first error vector signal and the first prestored approximation vector signal;

c) performing partitioned vector quantization on a first portion of the residual vector signal thereby generating at least one second index which corresponds to a second prestored vector signal which is an approximation of the first portion of the residual vector signal;

d) performing scalar quantization on a second portion of the residual vector signal thereby generating a third index corresponding to a prestored scalar signal which is an approximation of the second portion of the residual vector signal;

e) combining the first, second and third indices to form an encoded vector signal which is a compressed representation of the feature vector signal;

f) responding to the vector quantizer with a primary vector codebook containing indexed values representing prestored approximation vector signals wherein each indexed value and, thus, each prestored approximation vector signal corresponds to a particular index;

g) forming a tree-structured arrangement with the indexed values in the primary vector codebook wherein the indexed values are separated into groups with a group mean vector signal being generated and stored from the average of the prestored vector signals within the group such that the vector quantizer first performs an inter-group search to locate the group of indexed values corresponding to the prestored group mean vector signal which most closely approximates the first error vector signal and then performs an intra-group search to locate the indexed value corresponding to the particular prestored vector signal which most closely approximates the first error vector signal, such prestored vector signal serving as the first prestored approximation vector signal; and h) storing in memory or transmitting over a data transmission medium said encoded vector signal.

8. The method as defined in claim 7, further comprising the steps of:

f) performing a second linear prediction analysis on the encoded vector signal to generate a second error vector signal containing the first, second and third indices;

g) indexing the first index of the second error vector signal to determine the first prestored approximation vector signal and adding the first prestored approximation vector signal corresponding to the first index to the second error vector signal;

h) indexing the at least one second index of the second error vector signal to determine the second prestored approximation vector signal and adding the second prestored approximation vector signal corresponding to the second index to the second error vector signal; and i) indexing the third index of the second error vector signal to determine the prestored approximation scalar signal and adding the prestored approximation scalar signal corresponding to the third index to the second error vector signal;

wherein the second error vector signal having the first and second prestored approximation vector signals and the prestored approximation scalar signal added thereto forms a reconstructed vector signal which is an decompressed representation of the feature vector signal.

* * * * *